US007303116B2

(12) United States Patent
Cervera Cunill

(10) Patent No.: US 7,303,116 B2
(45) Date of Patent: Dec. 4, 2007

(54) FOLDING BOX

(75) Inventor: Eduardo Cervera Cunill, Sant Vicenc de Torello (ES)

(73) Assignee: Artesania Cervera, S.L., Sant Vicenc de Torello (ES)

( * ) Notice: Subject to any disclaimer, the term of this patent is extended or adjusted under 35 U.S.C. 154(b) by 139 days.

(21) Appl. No.: 10/550,319

(22) PCT Filed: Mar. 12, 2004

(86) PCT No.: PCT/ES2004/000112

§ 371 (c)(1),
(2), (4) Date: Sep. 21, 2005

(87) PCT Pub. No.: WO2004/085270

PCT Pub. Date: Oct. 7, 2004

(65) Prior Publication Data

US 2006/0213961 A1 Sep. 28, 2006

(30) Foreign Application Priority Data

Mar. 26, 2003 (EP) ..... 03380073

(51) Int. Cl.
*B65D 43/22* (2006.01)
*B65D 5/42* (2006.01)

(52) U.S. Cl. ..... 229/125.37; 220/324; 229/199

(58) Field of Classification Search ..... 229/125.37, 229/199, 199.1; 220/324, 326, 327
See application file for complete search history.

(56) References Cited

U.S. PATENT DOCUMENTS 928,586 A * 7/1909 Clark ..... 217/15
2,374,177 A * 4/1945 Conner et al. ..... 229/126
2,421,238 A * 5/1947 Borah ..... 229/122.25
2,775,389 A * 12/1956 Weiner ..... 229/199
3,031,125 A * 4/1962 Felton ..... 229/199
3,811,563 A * 5/1974 Fox, II ..... 220/324
3,974,933 A * 8/1976 Toth et al. ..... 220/327
4,476,994 A * 10/1984 Hope et al. ..... 220/327
4,509,645 A * 4/1985 Hotta ..... 229/125.37
4,534,489 A * 8/1985 Bartlett ..... 229/125.37
4,722,473 A * 2/1988 Sandrini et al. ..... 229/199
5,431,336 A * 7/1995 Clee ..... 229/199
5,518,170 A 5/1996 Rasmussen
5,638,977 A * 6/1997 Bianchi ..... 220/314

(Continued)

FOREIGN PATENT DOCUMENTS

DE 1140212 A 11/1962

(Continued)

*Primary Examiner*—Gary E Elkins
(74) *Attorney, Agent, or Firm*—Darby & Darby P.C.

(57) ABSTRACT

This invention relates to a folding box comprising a flexible sheet consisting of a single layer of boxboard. The inventive box comprises: adjacent portions having the same total surface area ash that of the rigid sides; a lateral flange which is fixed to the opposing adjacent portion, said sheet defining a tubular configuration, and—two flanges, namely an upper flange and a lower flange, which are used to fix the lids to the rest of the box in a permanent manner. The sides of the box opposite the aforementioned flanges are provided with holes which are used to mount pins, the ends of which are housed in holes in the inner parts of the lids, and said pins hold the lids in position when the box is closed.

5 Claims, 2 Drawing Sheets

U.S. PATENT DOCUMENTS 5,832,543 A * 11/1998 Bosserman ..... 220/326
5,875,916 A * 3/1999 Crockett et al. ..... 220/324
7,004,344 B2 * 2/2006 Fulton et al. ..... 220/324

FOREIGN PATENT DOCUMENTS

EP 0785141 A1 7/1997
EP 0832825 A1 4/1998
GB 2359250 A 8/2001

* cited by examiner

FOLDING BOX

CROSS-REFERENCE TO PRIOR APPLICATION

This is a U.S. national phase application under 35 U.S.C. 371 of International Patent Application No. PCT/ES2004/000112 filed Mar. 12, 2004, and claims the benefit of European Patent Application No. 03380073.4 filed Mar. 26, 2003 which is incorporated by reference herein. The International Application was published in Spanish on Oct. 7, 2004 as WO 2004/085270 A1 under PCT Article 21(2).

OBJECT OF THE INVENTION

The present invention refers to a foldable box, of the type comprising: rigid sides, at least one flexible sheet connecting the rigid sides forming hinging means which permit the arrangement of said sides forming a hollow, polygonal prismatic configuration, as well as the overlapping thereof, the box adopting a flattened configuration, and covers intended for closing the box bases when the sides define a prismatic configuration; each one of the covers being composed of an outer part with slightly larger dimensions than the inner cavity of the prismatic configuration and of an inner part intended to be introduced inside of said prismatic configuration when in the closed position.

BACKGROUND OF THE INVENTION

Currently, different foldable boxes provided with rigid sides exist on the market, connected together by means of one or more flexible sheets permitting the relative rotation of said rigid sides in order to form a hollow prismatic configuration or overlapping thereof, the box adopting a flattened configuration which permits reducing the volume occupied by the box when it is not in use.

Spanish Utility Model application number 248,234 discloses an improved container of the type of those constituted by semirigid material sandwich-type panels, connected together by means of flexible sheets fixed to the opposite ends of the panels and acting like a hinge.

In said Utility Model 248,234, the ends of the flexible sheets are housed and fixed between two of the layers of the sandwich-type panels constituting the sides of the box, so that said sheets remain in a visible position once the box is formed.

The length of the flexible sheets arranged between the successive panels implies an important drawback because once the container is assembled, it permits the sides thereof to have freedom, making the definition of a regular prismatic body and of a stable configuration significantly difficult.

Said Utility Model 248,234 also foresees that the container be provided with independent covers which subsequently will be fixed to the container body for the purpose of carrying out the closure of the bases thereof.

The use of dismountable container covers implies an additional drawback because said covers can be lost during storage or transport of the container, so that when the assembly of said container is carried out, the necessary elements to carry out its closure will not be available.

Spanish Utility Model application number 9,700,240 discloses a foldable box, which, like in the prior Utility Model, is composed of wooden sides connected together by means of a paper sheet reinforced by means of mesh, permitting said sheet the rotation or relative flattening of the sides, so that the box can adopt a prismatic configuration when in use, or a flattened configuration in which the space necessary for its transport is reduced.

Identically as in the aforementioned model, the foldable box of the utility model 9,700,240 contemplates fixing the wooden sides to the paper sheet reinforced with a mesh, leaving between the two wooden sides spaces acting like a hinge.

Identically as in the prior case, the portions of the reinforced paper sheet which remain between the rigid wooden sides considerably reduce the stability of the box once it is assembled, because it permits certain freedom to said rigid sides.

Likewise, the use of a paper sheet reinforced with mesh for the connection of the rigid sides implies an unnecessary increase in manufacturing costs of the box.

In said Utility Model 9,700,240, the use of covers is also contemplated, covers independent from the box body itself, which implies, as in the prior case, a risk of the loss thereof during transport or storage of the box in a disassembled state.

On the other hand, said registered background does not contemplate the use of any specific means which permit carrying out the retention of the cover in the closed position and its subsequent opening for the purpose of making it possible to reuse the box as many times as required.

DESCRIPTION OF THE INVENTION

The foldable box object of the invention, being of the aforementioned type, in other words, of those comprising rigid sides connected together by means of flexible sheets and closing covers, have constructive particularities focused on reducing manufacturing costs, especially in reference to the flexible sheet, to eliminate unnecessary allowances between the rigid panels forming the sides, to keep the covers permanently connected to the rest of the box, preventing the loss thereof, and providing it with closure means which permit repeatedly carrying out the retention of the covers in the closed position or its release, so that said box can be totally reusable.

According to the invention, the flexible sheet is entirely formed by a single layer of cardboard, in other words, without reinforcement meshes, which permits significantly reducing the cost of said sheet, there being defined in said flexible sheet by means of fold lines: contiguous portions whose total surface coincides with that of the rigid sides, a lateral flap extending from one of the contiguous end portions and which is fixed on the other contiguous end portion, said sheet defining a polygonal tubular configuration, and two flaps: an upper one and a lower one, which extend from two of the contiguous portions forming means for the permanent fixing of the covers to the rest of the box.

According to the aforementioned, the surface of the contiguous portions defined on the flexible sheet coincides with that of the rigid sides of the box, so that the opposite sides of said sides make contact together when they are in a coplanar arrangement, thereby ensuring that, in the box assembly condition, they will not remain spaced by an intermediate flexible sheet portion, which provides the box a better stability in the assembly position.

On the other hand, this feature significantly facilitates the tasks of fixing the rigid sides to the flexible sheet, since said fixing is carried out flat and the facing sides of the successive rigid sides connecting together, preventing these from being misaligned, which in reality happens to those boxes which leave a portion of the flexible sheet free between the successive rigid sides.

The definition of a lateral flap on the flexible sheet for fixing the flexible sheet on itself, such that said sheet defines a tubular configuration, significantly simplifies the box manufacturing tasks.

Furthermore, the definition of the two flaps on the flexible sheet, an upper one and a lower one, for holding the covers ensures that these remain permanently connected to the rest of the box, eliminating the risk of loss during the transport and the subsequent drawbacks that this implies.

According to the invention, the sides of the box opposite to the carriers of the flaps for fixing the covers, have holes for the assembly of pins whose ends are housed in holes made for that purpose in the inner parts of the corresponding covers, said pins carrying out the retention of the respective covers in the box closed position.

The existence of said holes and pins permits the box to be opened and closed as many times as necessary without suffering any kind of damage, which provides it with a reusable character.

According to the invention, the outer end of the pin corresponding to the upper cover of the box is provided with a ring simultaneously forming a pull intended to facilitate the holding and removal of said pin for opening the box, and an element for fixing a label or any other decorative element.

Likewise, it was foreseen that the upper and lower flaps of the flexible sheet have a width which is significantly equal to that of the outer parts of the corresponding covers and a length which is smaller than that of the inner parts.

Said upper and lower flaps are arranged between the inner and outer parts of the corresponding cover and fixed to them. In turn, the inner and outer parts of each one of the covers are fixed directly together by those overlapped surface portions and which are not occupied by the flaps of the flexible sheets arranged between them; in this manner, it is ensured that the inner and outer parts of the covers remain solidly fixed together and also to the corresponding flap of the flexible sheet.

DESCRIPTION OF THE FIGURES

In order complement the description being made and for the purpose of helping to better understand the features of the invention, a set of drawings is attached to the present specification which, with an illustrative and non-limiting character, show the following

PREFERRED EMBODIMENT OF THE INVENTION

Figure 1:
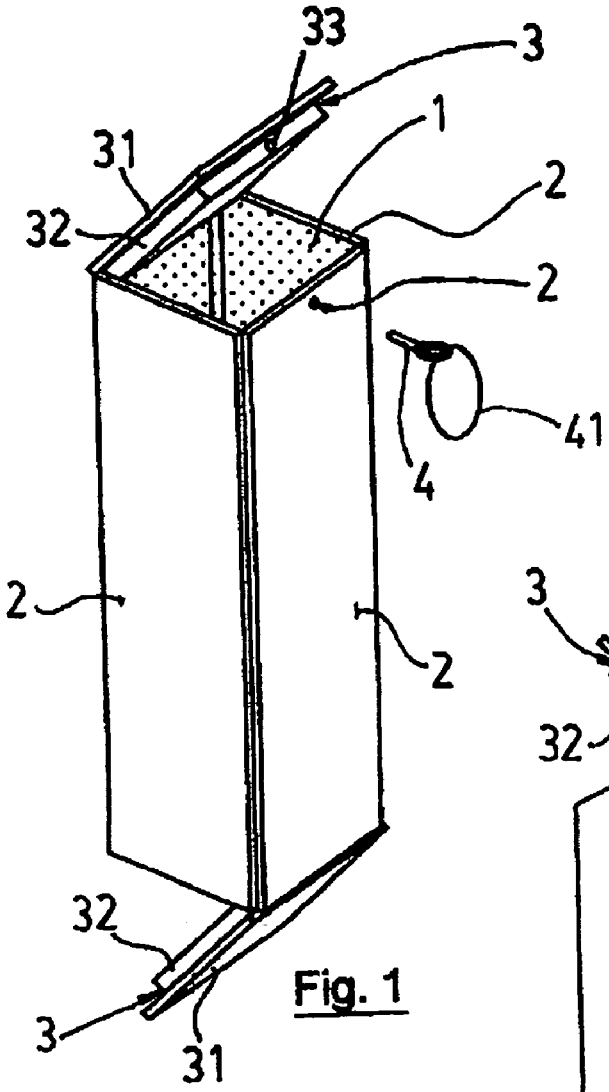
FIGS. 1 and 2 show respective perspective views in front perspective and in rear perspective of the foldable box object of the invention, with the covers opened and the retention pins of the covers removed.

As can be seen in the attached drawings, the box object of the invention is composed of a flexible cardboard sheet (1), rigid sides (2), preferably of wood, covers (3) for closing the box once assembled and pins (4) for the retention of the covers (3) in the closed position.

On the flexible sheet (1), the following are defined by means of fold lines: contiguous portions (11) whose surface coincides with that of the rigid sides (2) and intended to be fixed on the inner sides of said rigid sides (2), a side flap (12) starting from one of the contiguous end portions (11) and intended to be fixed on the contiguous portion (11) of the opposite end, so that said flexible sheet adapts a tubular configuration, and two flaps (13), extending from the upper and lower parts of two of the contiguous portions (11), forming the holding means of the covers (3).

Each one of the covers (3) is composed of an outer part (31) and an inner part (32) fixed on the opposite sides of the flaps (13), so that said covers (3) are arranged in the upper and lower ends of the box.

Figure 3:
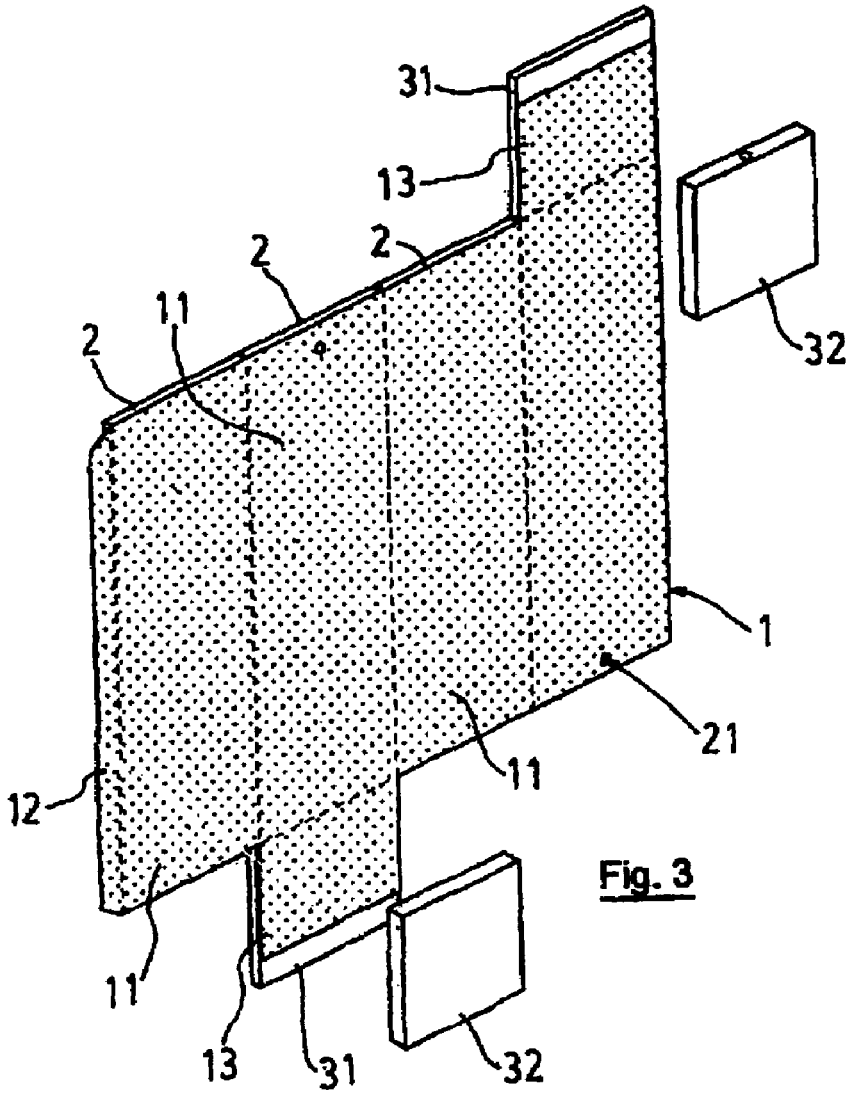
FIG. 3 shows a perspective view of the box in an intermediate manufacturing stage in which the flat development of the flexible sheet can be seen, the rigid sides and the outer parts of the cover being fixed on one of the sides thereof, whereas the inner parts of the cover, intended to be fixed on the opposite side of the flaps, are shown disassembled.
Figure 4:
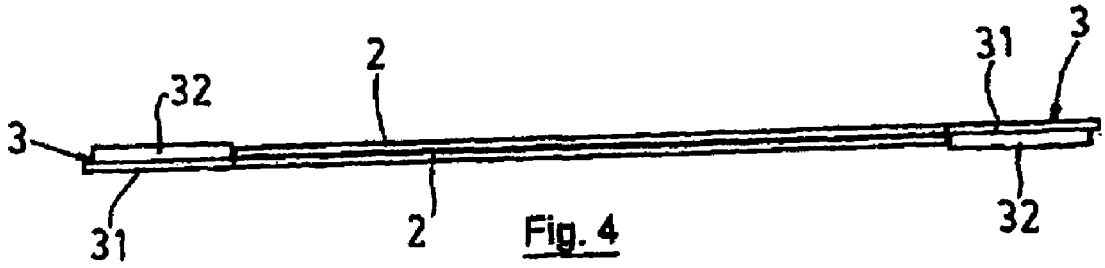
FIG. 4 shows a profile view of the box once assembled and folded.

As can be seen in FIG. 3, the flaps (13) have a width which is significantly equal to that of the outer parts (31) of the covers and a length smaller than that of the inner parts (32), so that a portion of said inner parts (32) is directly fixed on the outer parts (31) of the corresponding cover.

Figure 2:
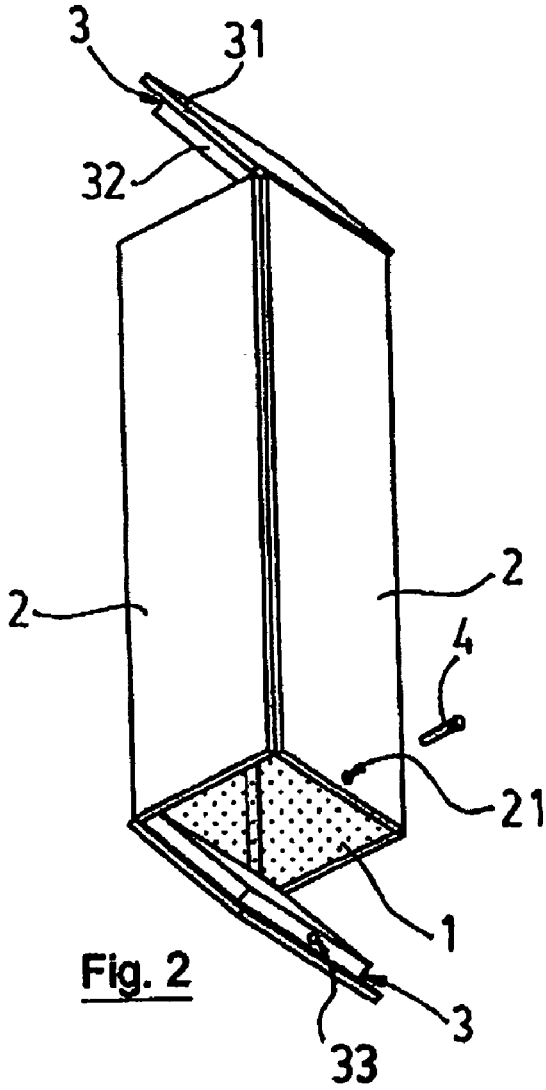

As can be seen in FIGS. 1,2 and 3 the sides of the box opposite to the carriers of the flaps (13) are provided with holes (21) for the assembly of pins (4) intended to be introduced in holes (33) defined on the inner parts (32) of the covers (3), for the purpose of retaining said covers (3) in the closed position of the box.

Likewise, one of the pins (4), specifically the one corresponding to the upper cover of the box, has a ring (41) on its end intended to facilitate the holding and pulling of the pin for releasing it from the box prior to opening said upper cover (3).

Likewise, this ring (41) permits fixing thereon a label or any other decorative element. Having sufficiently described the nature of the invention, as well as a preferred embodiment example, it is stated for opportune effects that the materials, shape, size and arrangement of the described elements can be modified, as long as this implies no alteration of the essential features of the invention claimed below.

The invention claimed is:

1. A foldable box comprising a plurality of rigid sides; at least one flexible sheet connecting said plurality of rigid sides to provide hinge means between each of said plurality of rigid sides, whereby said sides may be arranged to form a hollow prismatic configuration having an open top and bottom or may be arranged in superimposition to form a flat configuration, and top and bottom covers for closing said open top and bottom when said sides are arranged to form the prismatic configuration, each of said covers comprising an outer part of slightly larger dimension than the associated opening and an inner part sized to fit within the associated opening when the cover closes said opening; characterized in that said flexible sheet comprises a single layer of cardboard, fold liners on said sheet defining contiguous sheet portions, the surface of each sheet portion coinciding with the surface of a different one of said plurality of rigid sides, said flexible sheet having respective end portions, a side flap extending from one of said end portion and being connected to the other end portion of said flexible sheet to form a tubular configuration, an upper flap extending from a first sheet portion of said flexible sheet to form said top cover and a lower flap extending from a second sheet portion of said flexible sheet to form said bottom cover, respective holes provided in the sides of the box opposite said first and second sheet portion when said sides are arranged in said hollow prismatic configuration, an opening in each one of said inner parts adapted to be aligned with a respective one of the holes when said top and bottom covers close said open top and bottom, and pins adapted to extend through the hole and opening to retain said respective covers in the closed position.

2. A box according to claim 1, wherein the upper and lower flaps of the flexible sheet have a width which is significantly equal to that of the outer parts and a smaller length than the inner parts.

3. A box according to claim 1, wherein the flaps are arranged between the outer part and the inner part of the corresponding cover and fixed to the two parts.

4. A box according to claim 1, wherein the parts of each one of the covers are directly fixed together by those overlapping surface portions and which are not occupied by the flap of the flexible sheet located between said parts.

5. A box according to claim 1, wherein the pin retaining the top cover in the closed position has an outer end, and a ring on said outer end forming a pull to facilitate the holding and removal of the pin during the opening of said box, and an element for fixing a label or decorative element.

* * * * *